US006731714B1

(12) United States Patent
Bugeon et al.

(10) Patent No.: US 6,731,714 B1
(45) Date of Patent: May 4, 2004

(54) METHOD FOR MEASURING TRITIUM ACTIVITY IN A RADIOACTIVE WASTE DRUM

(75) Inventors: Philippe Bugeon, Fontaine les Dijon (FR); Bernard Bachet, Maisannay la côte (FR); Didier Devillard, Norges la Ville (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/647,735

(22) PCT Filed: Apr. 6, 1999

(86) PCT No.: PCT/FR99/00785

§ 371 (c)(1),
(2), (4) Date: Oct. 24, 2000

(87) PCT Pub. No.: WO99/51997

PCT Pub. Date: Oct. 14, 1999

(30) Foreign Application Priority Data

Apr. 7, 1998 (FR) ..... 98 04302

(51) Int. Cl.[7] ..... G21F 5/00; G21C 17/00

(52) U.S. Cl. ..... 376/256; 376/272; 376/257; 250/506.1

(58) Field of Search ..... 376/272, 256, 376/257; 250/506.1, 507.1; 473/248, 249, 255, 644

(56) References Cited

U.S. PATENT DOCUMENTS 3,961,189 A * 6/1976 Hiller et al. ..... 376/256
4,075,312 A * 2/1978 Tanaka et al. ..... 423/648 A
4,196,176 A * 4/1980 Galloway ..... 423/248
4,274,007 A * 6/1981 Baatz et al. ..... 250/506.1
4,427,893 A * 1/1984 Queiser et al. ..... 250/506.1
4,447,733 A * 5/1984 Baatz et al. ..... 250/506.1
4,562,000 A 12/1985 Ringel
4,808,831 A * 2/1989 Whiddon ..... 250/506.1
4,882,093 A 11/1989 Giroux et al.
5,080,693 A * 1/1992 Bourne et al. ..... 376/256
5,089,214 A * 2/1992 Graham et al. ..... 376/272
5,464,988 A * 11/1995 Rossmassler et al. .... 250/507.1
5,473,643 A * 12/1995 Hohorst ..... 376/159

FOREIGN PATENT DOCUMENTS

JP 4024 583 * 1/1992 ..... 376/256
JP 07 151879 A 6/1995

OTHER PUBLICATIONS

CONF–810372–9, pp. 161–170, Muller, 1981.*
DE 92010061 (Tritium Measurement Technique Using In–Bed Calorimetry), Klein et al, 1991.*
Proc. 3rd Int. Symp. Adv. Nucl. Energy Res., pp 85–89, Mahara et al, 1991.*
J. Appl. Phys. vol. 57, No. 6, pp. 1855–1860, Mitchell et al, Mar. 1985.*
DE 00013544 (Aquifer Transport of TH, U, RA, and RN in Solution and Colloids. 1997 Annual Progress Report)., Wasserburg, Jan. 1997.*
ATOMKI Annual Report, v.12, pp. 58–59, Palcsu et al, May 1999.*

* cited by examiner

*Primary Examiner*—Harvey E. Behrend
(74) *Attorney, Agent, or Firm*—Pearne & Gordon LLP

(57) ABSTRACT

The invention relates to a method of measuring the tritium activity of a drum (1) of radioactive waste containing a quantity of radioactive waste (2) and a free volume, the method consisting of measuring the quantity of $^3$He produced by the decay of the tritium contained in said radioactive waste during a defined period of time and deducing from it the corresponding activity of the tritium contained in said radioactive waste (2).

10 Claims, 1 Drawing Sheet

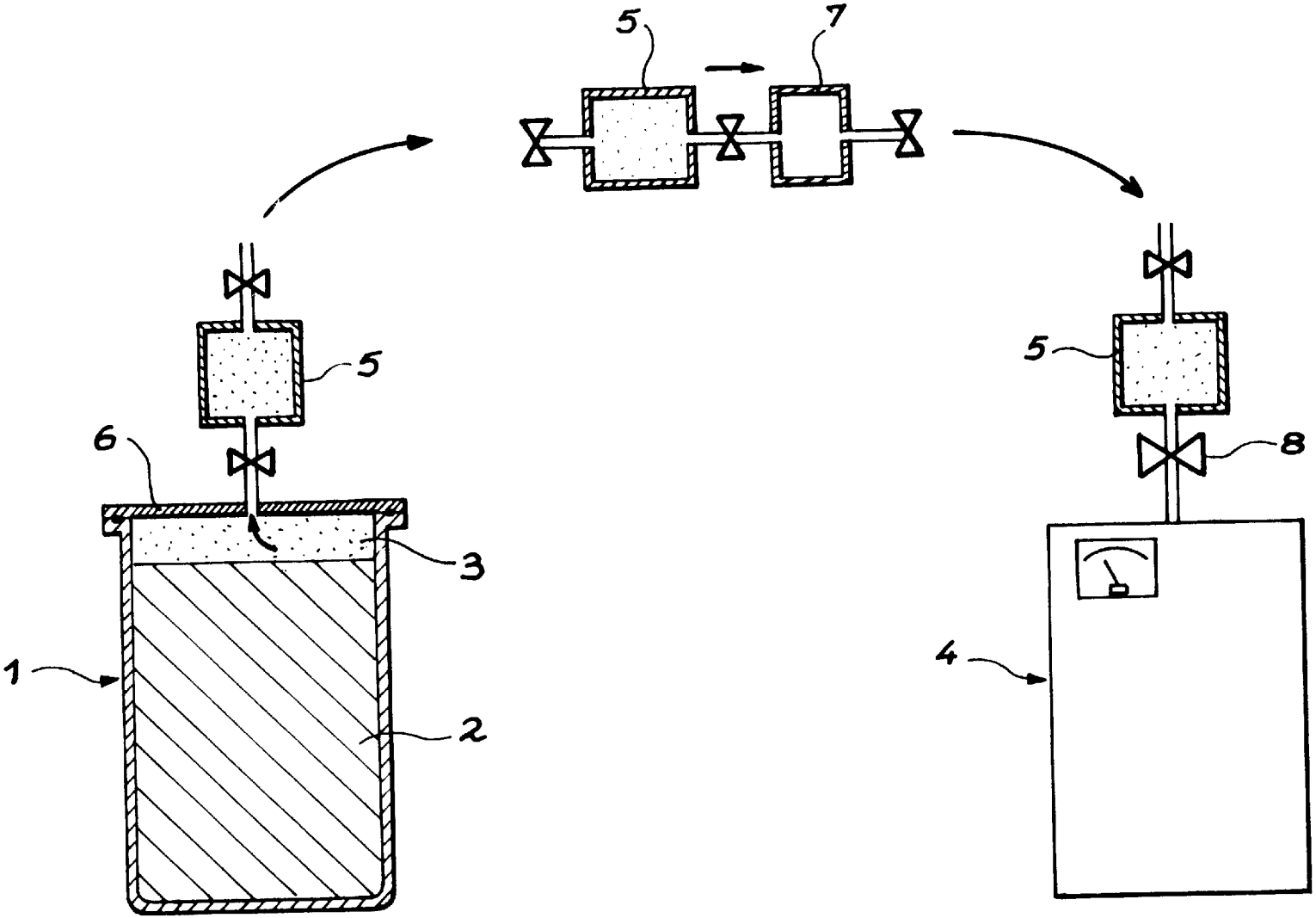
8
5
4
7
5
3
2
5
6
1

METHOD FOR MEASURING TRITIUM ACTIVITY IN A RADIOACTIVE WASTE DRUM

TECHNICAL FIELD

This invention relates to a method of measuring the tritium activity of a drum of radioactive waste.

STATE OF THE PRIOR ART

Tritium is a radionuclide present in radioactive waste. It is an unstable isotope of hydrogen. Its decay into $^3$helium is accompanied by the emission of a β particle with a negative charge which corresponds to an electron. The distances traveled by these β particles are much reduced. They do not exceed 6 μm in water and 5.7 mm in air. This property excludes any possibility that the radiation from the tritium could be detected through the walls of the drum or within the solid or liquid waste.

In order to measure the amount of tritium in the radioactive waste, other methods of measurement must be used that exploit the main characteristics of tritium that enable its presence to be detected. Its atomic mass permits its separation by mass spectrometry and by chromatography, if it is in the gaseous phase. Thanks to the β radiation, it is possible to make use of the scintillation counting technique, most commonly in a liquid medium. The absorption of β radiation in the surrounding medium induces a release of heat. This flow of heat can be quantified by calorimetry.

In the majority of applications, it is these physical and chemical properties which are exploited in order to measure the tritium. The field of tritiated waste is not outside this general rule. Before being able to use the techniques mentioned above, it has often proved necessary to proceed via steps involving the preparation of tritiated samples. These preliminary phases, which are sometimes complicated, depend on the physical and chemical condition of the tritium and the matrix within which it is trapped. The level of activity being looked for, the chemical form of the tritium and the matrix therefore define the criteria for choosing the measurement techniques to be used.

Tritium is also present in organic solid waste, for example in polyethylene/vinyl acetate or PEVA or in polyvinyl acetate or PVC, arising from overshoes, gloves, inner gloves etc. The diversity of this waste reinforces the difficulty of characterizing it. Experience has shown a high degree of heterogeneity in the distribution of the activity. When all these types of products are mixed, the chance that a few grams of samples can be representative is very uncertain. Nevertheless, burning a sample whose weight ranges from 0.1 to 1 g under a current of oxygen enables one to estimate the activity of some samples at levels of a few Bq/g.

Measuring the dose of tritium in a gaseous or aqueous phase makes use of traditional techniques which have been well proven, the most common being scintillation and mass spectrometry. When the medium is homogeneous, simple sampling enables one to obtain a reliable quantitative result within an exhaustive range of concentrations.

However, the determination of the activity of relatively slightly contaminated tritiated waste remains particularly difficult. In this precise case, the use of destructive analytical techniques is not satisfactory because of the relative uncertainty of how representative the sample is. Up to now, no simple reliable method has existed to characterize technologically tritiated waste.

Rigorous and effective management of tritiated waste requires the measurement of the quantity of tritium contained in the parcel. For a specialist body to take responsibility for this waste, the tritium activity must be guaranteed to be less than a defined threshold, for example, $10^9$ Bq (0.027 Ci) in a 200 liter drum. No reliable technique that is economically acceptable enables one to fulfil this requirement at the present time. Calorimetry on 200 liter drums can be carried out but this does not permit one to measure tritium activities less than $1.8\times10^{14}$ Bq (5000 Ci).

Unless it is in liquid or gaseous form, slightly contaminated tritiated waste is very difficult to characterize, especially organic waste, each sampling of which is fraught with great uncertainty as to whether it is representative. It is possible that the problem can be resolved by homogenizing the waste by grinding it. The lack of sensitivity of calorimetry does not allow it to be used. From the point of view of analytical controls, an important deficiency continues to exist. The solution is to arrive at an overall control of the drum that is non-destructive and does not generate waste.

DESCRIPTION OF THE INVENTION

In order to remedy this problem, according to this invention a technique is proposed that is non-destructive, reliable and economic and which enables one to quantify the activity of tritiated waste enclosed in bags, for example PVC bags, themselves placed within a drum with an unknown free volume and with unknown leakage.

The principle consists of measuring the quantity of $^3$helium arising from decay of the tritium, from a sample taken from the gaseous atmosphere surrounding the waste. This quantity of formed helium is proportional to the tritium activity present. By way of example, waste with an activity of $10^9$ Bq (0.027 Ci) gives rise, in one year, to a release of $^3$helium leading to a concentration of 0.0055 ppm of this gas in a volume of 200 liters.

Tritium is $\beta^-$ radioactive. It decays giving $^3$helium, an electron and an anti-neutrino according to the reaction:

$$T \rightarrow {}^3He + e^- + \bar{\nu}$$

The half life of the tritium is 12.34 ±0.02 years. The number of atoms of $^3$helium generated is directly related to the number of atoms of tritium present through the equation:

$$N_{3He} = N_T \cdot (1 - e^{-\lambda t})$$

where $N_{3He}$=the quantity of $^3$helium formed during time t, $N_T$=the quantity of tritium initially present, $\mu$=the radioactive constant of tritium.

Hence the subject of the invention is a method of measuring the tritium activity of a drum of radioactive waste containing a quantity of radioactive waste and a free volume. The method consists of measuring the quantity of $^3$He produced by the decay of the tritium contained in said radioactive waste over a defined period of time and deducing from this the corresponding activity of the tritium contained in said radioactive waste. The quantity of $^3$He produced may advantageously be evaluated by a leak detector.

The tritiated waste enclosed in the bags, taken overall comprise a single source of $^3$helium which flows into the free volume of the drum. The partial pressure of the gas present is a function of the flow rate of $^3$helium from the tritium source (and hence the activity), the free volume, the tightness of the seal of the drum (a part of the gas created will escape from it) and the confinement time.

According to the invention, the measurement can be carried out in three steps: calibration and measurement of the concentration of $^3$helium, measurement of the free volume in the drum and of the tightness of the drum.

The method according to the invention may therefore comprise the following operations:

a) the taking of a sample of the gas contained in the drum and evaluation of the quantity of $^3$He contained in the sample using a leak detector, b) measurement of the free volume of said drum, c) measurement of the tightness of the drum to determine the leakage rate from it, d) calculation of the flow rate of $^3$He using data obtained from operations a), b) and c), e) determination of the tritium activity of the drum in relation to the flow rate of $^3$He calculated in operation d).

Preferably, during operation a), parasitic gases are removed from the sample before making the evaluation of the quantity of $^3$He. During this operation, said evaluation may comprise the comparison of the sample taken with a gas at the same pressure and having a known $^3$He concentration.

Operation b) can be carried out by injecting a known quantity of $^4$He into the drum and then measuring the partial pressure of $^4$He in the drum, and finally by determining the free volume of said drum from the known quantity of $^4$He and the measurement of the partial pressure of $^4$He. This measurement of the partial pressure of $^4$He can be obtained by taking a sample of the gas contained in the drum and evaluating the quantity of $^4$He contained in this sample using a leak detector.

Operation c) may be carried out by injecting a known quantity of $^4$He into the drum, then measuring for the first time the partial pressure of $^4$He in the drum and then, after a period of time defined in relation to said first time, measuring the partial pressure of $^4$He in the drum for a second time. The rate of leakage from the drum is then calculated from these values of the partial pressures of $^4$He and said defined period of time between these partial pressure measurements.

In the case where the apparent leakage of $^3$He from the drum is estimated as being equal to the quantity of $^3$He produced through the decay of the tritium contained in said radioactive waste, the measurement of said quantity of $^3$He produced may be simply obtained by placing the drum within an enclosure intended to collect the $^3$He leaking from the drum and by evaluating this quantity of $^3$He using the leak detector.

BRIEF DESCRIPTION OF THE DRAWING

The invention will be better understood and other advantages and particular features will become apparent on reading the description that follows, given by way of a non-limitative example, accompanied by the appended FIGURE which illustrates a method of measuring the tritium activity of a drum of radioactive waste, in accordance with the present invention.

DETAILED DESCRIPTION OF AN EMBODIMENT OF THE INVENTION

The appended FIGURE shows a drum 1, closed by a cover 6 and containing radioactive waste 2 arranged in PVC bags to allow a free volume 3 to remain in the drum. Reference number 4 designates a leak detector fitted with a mass spectrometer. A sampling tube 5, with a capacity of the order of 2 liters, allows one to take a sample of gas from the free volume 3 of the drum, through the cover 6.

The signal supplied by a leak detector depends, amongst other things, on the value of the flow rate of tracer gas and the pressure of the tracer gas existing upstream of this leak.

The concentration of $^3$He in the sampling tubes is deduced after calibration using sampling tubes with known concentrations of $^3$He, under the same conditions.

The concentration of $^3$He in the sampling tubes is low, of the order of parts per billion. However, after removal of gases other than $^3$He, $^4$He and Ne from the sampling tube using an activated carbon trap, a pressure of the order of 10 millibars can be reached in the sampling tube. Under these conditions, the concentration of $^3$He in the sampling tube is multiplied by a factor of 100.

In the appended FIGURE, the sampling tube 5 is shown disconnected from the drum 1 and connected to an activated carbon trap 7 immersed in liquid nitrogen. After the trap 7 has exerted its action of attracting the gases other than $^3$He, $^4$He and Ne, the sampling tube 5 is connected to the leak detector through a micrometric valve 8. The sample to be checked is then placed upstream of the calibrated leak for the detector 4.

Calibration is carried out by replacing the sampled gas by a gas at the same pressure and of known $^3$He concentration.

The measurement of free volume (which is the volume offered to the $^3$He, that is to say the volume surrounding the bags of waste and the volume in the bags into which the $^3$He can diffuse) of the drum 1 is carried out by injection into the drum of a known quantity of $^4$He. After diffusion of this gas into the volume of the drum, the partial pressure of $^4$He is measured by means of the technique used for $^3$He. The free volume is deduced using the equation:

$$V_{free} = \frac{quantity^4He}{partial\ \ pressure_{(t=0)}}$$

In order to measure the tightness of the drum, the partial pressure of $^4$He is measured again three months after the first measurement. The leakage rate $Q_{drum}$ of the drum is a function of the pressure variation in the free volume. This function follows the diffusion law for helium through the polymers:

$$Q_{drum} = \text{function of } \frac{[initial\ \ pressure_{(t=0)} - pressure_{(t=3\ \text{months})}] \times V}{t(3\ \text{months})}$$

A calculation program enables one to obtain the value of the flow rate from the $^3$He source as a function of the concentration of $^3$He, the free volume, the tightness of the drum and the period of confinement of the waste.

The tritium activity is deduced from the value of the flow rate from the source of the $^3$He.

Given the order of magnitude of the tightness of the waste drums ($10^{-3}$ Pa.m$^3$/s), after a few years of confinement, the partial pressure of $^3$He inside the drum is such that the system stabilizes itself. The apparent leakage from the drum ($^3$He which leaves the drum) is equal to the flow rate from the tritium source (the $^3$He which is created). Under these conditions, sampling in the drum is no longer necessary. It suffices to measure the apparent leakage from the drum to know its tritium activity. This measurement can be carried out by placing the 200 liter drum, for about 20 hours, inside a enclosure that is only slightly larger so as to limit the dead volume to about twenty liters, and, as previously, measuring the concentration of $^3$He.

By way of a demonstration, this method for the measurement of tritium activity was applied to two steel containers containing a tritium source (constituted by 0.1 liter of tritiated water) and having a free volume of 12.7 liters. The activities of the sources enclosed in these containers were $0.455 \times 10^9$ Bq (12.3 mCi) for the first container and $4.55 \times 10^9$ Bq (123 mCi) for the second container. The ambient gas contained in these containers was the subject of analyses at regular time intervals, conforming to the method of this invention. The results shown in Table I (for the first container) and in Table II (for the second container) comprise theoretical values of the expected concentrations of $^3$He and the values of the concentrations deduced from the measurements as a function of the number of days that had passed since the placing of the sources in the containers. The difference between the theoretical and measured concentrations is also shown.

The results obtained with the $0.455 \times 10^9$ Bq (12.3 mCi) source show that an activity source less than the threshold mentioned above of $10^9$ Bq (27 mCi) can be characterized using the method of this invention.

TABLE I 100 ml of water - total activity of 12.3 mCi ($4.55 \times 10^8$ Bq)

| Number of days | Theoretical concentration of $^3$He (ppm volume) ± 5% | Measured concentration of $^3$He (ppm volume) | Difference (%) |
|---|---|---|---|
| 14 | 0.0021 | 0.0029 | 38 |
| 21 | 0.0033 | 0.0043 | 30 |
| 28 | 0.0041 | 0.0051 | 24 |
| 35 | 0.0050 | 0.0060 | 20 |
| 42 | 0.0058 | 0.0070 | 21 |
| 49 | 0.0067 | 0.0083 | 24 |
| 72 | 0.0085 | 0.0079 | −7 |
| 77 | 0.0105 | 0.0104 | −1 |

TABLE II 100 ml of tritiated water - total activity of 123 mCi ($4.55 \times 10^9$ Bq)

| Number of days | Theoretical concentration of $^3$He (ppm volume) ± 5% | Measured concentration of $^3$He (ppm volume) | Difference (%) |
|---|---|---|---|
| 0 | 0 | — | |
| 8 | 0.008 | 0.009 | 13 |
| 17 | 0.019 | 0.018 | −5 |
| 28 | 0.031 | 0.028 | −10 |
| 50 | 0.056 | 0.052 | 4 |

What is claimed is:

1. Method of measuring the tritium activity of a drum of radioactive waste containing a quantity of radioactive waste and a free volume, consisting of measuring the quantity of $^3$He present in the free volume of the drum and produced by the decay of the tritium contained in said radioactive waste during a defined period of time and deducing from it the corresponding activity of the tritium contained in said radioactive waste.

2. Method according to claim 1, in which the quantity of $^3$He produced is measured by a leak detector.

3. Method according to claim 2, comprising the following operations:

a) the taking of a sample of the gas contained in the drum and evaluation of the quantity of $^3$He contained in the sample using a leak detector, b) measurement of the free volume of said drum, c) measurement of the tightness of the drum to determine the leakage rate from it, d) calculation of the flow rate of $^3$He using data obtained from operations a), b) and c), e) determination of the tritium activity of the drum in relation to the flow rate of $^3$He calculated in operation d).

4. Method according to claim 3, in which during operation a), parasitic gases are removed from the sample before making the evaluation of the quantity of $^3$He.

5. Method according to claim 3, in which during operation a), said evaluation comprises the comparison of the sample taken with a gas at the same pressure and of known $^3$He concentration.

6. Method according to claim 3, in which operation b) is carried out by injecting a known quantity of $^4$He into the drum and then measuring the partial pressure of $^4$He in the drum, and finally by determining the free volume of said drum from the known quantity of $^4$He and the measurement of the partial pressure of $^4$He.

7. Method according to claim 6, in which the measurement of the partial pressure of $^4$He is obtained by taking a sample of gas contained in the drum and evaluating the quantity of $^4$He contained in this sample by a leak detector.

8. Method according to claim 3, in which operation c) is carried out by injecting a known quantity of $^4$He into the drum, then measuring for the first time the partial pressure of $^4$He in the drum and then, after a period of time defined in relation to said first time, measuring the partial pressure of $^4$He in the drum for a second time, the leakage rate from the drum then being calculated from these values of the partial pressures of $^4$He and said defined period of time between these partial pressure measurements.

9. Method according to claim 2, in which the apparent leakage of $^3$He from the drum being estimated as being equal to the quantity of $^3$He produced through the decay of the tritium contained in said radioactive waste, the measurement of said produced quantity of $^3$He is obtained by placing the drum within an enclosure intended to collect the $^3$He leaking from the drum and by evaluating this quantity of $^3$He using the leak detector.

10. The method according to claim 1, further comprising a step of measuring the free volume in the drum.

* * * * *

UNITED STATES PATENT AND TRADEMARK OFFICE

CERTIFICATE OF CORRECTION

PATENT NO. : 6,731,714 B1
DATED : May 4, 2004
INVENTOR(S) : Philippe Bugeon et al.

It is certified that error appears in the above-identified patent and that said Letters Patent is hereby corrected as shown below:

Column 2,
Line 49, please delete "$\mu$=" and insert therefor -- $\lambda$= --

Signed and Sealed this

Twenty-seventh Day of July, 2004

JON W. DUDAS
*Acting Director of the United States Patent and Trademark Office*